US005082530A

United States Patent [19]

Keskiivari et al.

[11] Patent Number: 5,082,530

[45] Date of Patent: * Jan. 21, 1992

[54] METHOD AND DEVICE IN HEADBOX OF PAPER, BOARD OR PULP DRYING MACHINE

[75] Inventors: Juha Keskiivari; Vesa Rommi; Timo Rosendal; Teuvo Virkkunen, all of Karhula; Veijo Virtamo, Kotka, all of Finland

[73] Assignee: Valmet-Karhula Inc., Finland

[ * ] Notice: The portion of the term of this patent subsequent to Dec. 24, 2008 has been disclaimed.

[21] Appl. No.: 633,681

[22] Filed: Dec. 26, 1990

[30] Foreign Application Priority Data

Dec. 22, 1989 [FI] Finland ..... 896202

[51] Int. Cl.[5] ..... D21F 1/06

[52] U.S. Cl. ..... 162/216; 162/337; 162/343

[58] Field of Search ..... 162/216, 212, 336, 337, 162/343, 341, 338

[56] References Cited

U.S. PATENT DOCUMENTS

| | | | |
|---|---|---|---|
| 3,516,905 | 6/1970 | Dennis et al. | 162/337 |
| 3,802,960 | 4/1974 | Spengos et al. | 162/343 |
| 3,837,999 | 9/1974 | Chung | 162/101 |
| 4,133,715 | 1/1979 | Hergert | 162/341 |
| 4,162,189 | 7/1979 | Kirjavainen | 162/337 |
| 4,285,767 | 8/1981 | Page | 162/343 |
| 4,406,741 | 9/1983 | Kirjarainen | 162/343 |
| 4,888,094 | 12/1989 | Weisshuhn | 162/216 |

FOREIGN PATENT DOCUMENTS

| | | |
|---|---|---|
| 3439051A1 | 3/1986 | Fed. Rep. of Germany . |
| 37030775A1 | 3/1988 | Fed. Rep. of Germany . |
| 73765 | 7/1987 | Finland . |

*Primary Examiner*—Karen M. Hastings
*Attorney, Agent, or Firm*—Nixon & Vanderhye

[57] ABSTRACT

The flow ratio of a paper machine headbox is adjusted by arranging such a by-pass out from the slice chamber that the flow conditions, such as the speeds and turbulences in all parts of the headbox remain unchanged regardless of the adjustment. The adjustment is carried out by opening the slice chamber wall or by using a separate discharging device positioned inside the slice chamber.

17 Claims, 8 Drawing Sheets

METHOD AND DEVICE IN HEADBOX OF PAPER, BOARD OR PULP DRYING MACHINE

This invention relates to a headbox of a paper, board or pulp drying machine which is later referred to as the headbox or the headbox of a paper machine.

The present invention relates to a method for controlling the volume of the headbox slice flow in a way that does not influence the operation of the headbox turbulence generator or the parts located before it in the flow direction or, in addition, which does not change the speed or direction of the flow inside the slice chamber. This control method can be used in addition to the normal control of the feed pump output and in an independent way of it.

BACKGROUND AND SUMMARY OF THE INVENTION

The internal dimensions of the headbox of a paper machine determine the maximum and minimum values for the flow volume running through the headbox, values between which an acceptable web quality is obtained.

Should the flow volume exceed the maximum value, the flow speeds in the headbox become so high that the distribution of stock in the direction of the breadth of the headbox becomes uneven and, in addition, the output flow from the headbox as it touches the wire is too turbulent to form a satisfactory web.

If the flow volume is below the minimum value, the stock may be unevenly distributed in the direction of breadth of the headbox. However, the turbulence below the minimum value is too weak, and the fibres start fastening on one another forming fibre bundles, i.e. flocs.

These extreme limits are diffuse to some extent yet they are so clear that their existence is generally known.

Paper's weight grade or mass divided by area (the so called grammage) is dependent on the machine speed and the consistency of the stock flowing from the headbox. Machines that produce grades with very different grammages, like boxboard machines, have large speed and consistency ranges. This is due to the fact that attempts are made to produce light grades at a low consistency in order to achieve good formation and at a high speed to maximize production. In order to produce heavy grades, the consistency must be increased and the machine speed reduced because the other parts of the paper machine usually set the limits for increased production. Since the slice flow volume is directly proportional to speed and in inverse relation to the consistency, the relation of the maximum and minimum flow volume of a headbox of this kind of machine is high. In the following, this relation will be referred to as flow ratio (S), and it can be presented in a formula:

$$S = Q\max / Q\min$$

in which

S = flow ratio

Qmax = the highest flow-through volume applicable to a headbox which gives an acceptable web quality and sufficient runnability Qmin = the lowest flow-through volume on corresponding conditions The flow ratios (S) attainable with the present headbox structures have, in several cases, turned out to be insufficient to guarantee an acceptable quality of the final product at the extreme limits of the grammage range. The flow ratio of a headbox should be at least as high as the relation of the highest and lowest running capacity of the paper machine. The best result, however, is reached if the headbox flow ratio is increased to such an extent that the range of the real flow volume running through a headbox is clearly within the flow range determined by the flow ratio.

In rectifier roll headboxes, the flow ratio (S) is approximately 2.5. The weak point of a hydraulic headbox is a smaller control range, its flow ratio (S) varies between 1.5 and 2.0 depending on the conditions.

It is previously known that to the both above mentioned types of headbox additional features have been applied with a purpose to adjust the flow ratio of the headbox in question, or, in some cases, only to increase/decrease the amount of stock or water in the slice chamber in order to correct the local defects occurring in the slice flow to produce a better web quality.

The prior art solutions, however, have shortcomings that the present invention will eliminate. A typical defect is that the realized flow control method changes the flow speeds in the entire headbox. Another weakness is that the closing of some channels of a headbox causes danger of clogging and thus the access of fibre bundles onto the wire. The third defect is the arrangement of the by-pass in a manner that the pattern of turbulence in the slice chamber undergoes a fundamental change. The fourth defect comparable with the latter one is that a decreased flow volume is directed to a slice chamber with constant dimensions where the reduced flow speed spoils the turbulence. A fifth defect is the impractical mechanical solutions for achieving the required adjustments.

The present invention solves all of the above mentioned five shortcomings and, in addition, gives an opportunity to use the same headbox for the production of a multiply web.

BACKGROUND PRIOR ART

U.S. Pat. No. 4,133,715 discloses a hydraulic headbox comprising a turbulence generator of tubular construction and a slice chamber forming an angle of about 75° with it, the upper wall of which is pivoted to the upper edge of the manifold, and which thus can be adjusted around the pivot points in question thus increasing or decreasing the height of the slice chamber, most near the slice opening. As a result of this adjustment, the height of the slice chamber changes slightly while the manifold discharge area feeding stock into the slice chamber remains constant. No stock is removed from the slice flow but all stock that was fed into the headbox flows out through the slice. This kind of headbox can operate with a flow ratio of S=2.0 at the highest producing a poor quality web close to the maximum and minimum flow settings. The runnability suffers at the same time. The example is a basic solution of a headbox without a flow control system.

U.S. Pat. No. 3,972,771 discloses a rectifier roll headbox provided with a turbulence generator and a slice chamber positioned in line. The height of this slice chamber can be adjusted both by the method described in the above reference and, in addition, by vertically moving the pivoting point of the slice chamber upper wall. The vertical transfer of the pivot point downwards causes the upper turbulence generator openings to close or, in other words, the number of the active turbulence generator pipes decreases. When the flow rate is reduced in the slice chamber, and therefore also in the turbulence generator, it is also reduced in all other parts of the headbox. The flow rate may be reduced to such an extent that it may go below the operating range of, for example, the header.

DE 3439051 discloses a solution for a hydraulic headbox (FIG. 7) in which a small amount of the stock flowed into the slice chamber (61) is let out back to the recycling through a hatch (59) instead of letting it flow to the slice opening, and thus the flow rate of the slice opening is decreased although the flow rate of the turbulence generator is kept at a high level in order to achieve a good turbulence. Another stock discharge opening is the slide (58). The opening of the slide naturally decreases the flow rate of the turbulence generator (54). The objective of the invention is not the adjustment of the flow ratio but a better formation control. This kind of solution, if it were used for discharging an essential amount of the stock flow from the slice flow, does not create a flow stable enough in the slice chamber. This is due to the fact that the dimensions of the slice chamber do not change as the function of the by-pass setting. Moreover, the separation point of the flow causes detrimental whirls in the flow running to the slice opening.

U.S. Pat. No. 4,162,189 discloses a headbox where the upper wall of the slice chamber (20*a*) can be raised or lowered utilizing a guideway (21) (FIG. 1). It is also possible to discharge stock here by letting some stock to flow over the thresold (26*a*) into the discharge pipe (27). The objective of this arrangement, however, is to keep the stock level (S) constant and not to act as a slice flow reducer. This kind of overflow structure can be found in numerous headboxes. The area of the turbulence generator (15) is unadjustable. The surface level of stock (S) is determined by the thresold (26*a*). The slice chamber height adjustment is here only a way to adjust the slice opening.

In U.S. Pat. No. 3,837,999 the slice chamber cross section can be seen in FIGS. 3, 4, 6, and 7. The dimensions of the slice chamber in FIG. 3 can be altered by installing a solid item (44) inside the slice chamber. Presumably, there is no turbulence generator in this headbox. The adjustment method is so troublesome that it is not considered viable in the paper making art. The chief aim is the adjustment of the slice opening which becomes evident in FIGS. 6 and 7.

U.S. Pat. No. 3,802,960 discloses a headbox producing a single- or multi-layer web. Item (20) can be regarded as a turbulence generator and item (23) as a slice chamber. A movable wedge (29) can be positioned inside the turbulence generator. The cross-sectional area of the turbulence generator (20) as well as that of the slice chamber (23) can be changed with this wedge. However, a rather big flow change is achieved with a small move of the wedge, and the state of the stock turbulence changes in a way that is difficult to predict. No by-pass is used. The workshop manufacture of the device is relatively difficult. Even small defects in the dimensions cause considerable changes in the flow pattern. The objective of the invention is not the flow ratio adjustment but turbulence control and improved quality of the slice flow. The apparatus is unsuitable for high (over 1.5%) stock consistencies since, after the turbulence generator (20), the stock flow towards the slice is more or less laminar, i.e. the changes in direction and speed are minimal. Turbulence can be achieved with very high stock speeds only. If the speeds are reduced, the risk of floc forming is very high. Nor is the support method of the wedge suitable for wide machines due to the wedge deflection. The wedge bends in the middle and vibrates squeezing the headbox mainly in the middle part. The changes in speed and consistency are difficult to control.

U.S. Pat. No. 4,285,767, like the above, describes the adjustment of a slice chamber with the help of an internal wedge. The area of the discharge surface feeding the slice chamber of the turbulence generator (22, 23) remains constant in this invention, too. No by-pass is used.

FI Application No. 853293 presents a very similar kind of solution to U.S. Pat. No. 3,972,771 this time applied to a hydraulic headbox. In FIGS. 1 and 2, the uppermost rows of the manifold pipes of the turbulence generator, or, in FIGS. 3 and 4, the lowest rows of the manifold pipes can be covered by a slide (10*a*), and the pivoted top wall (8) of the slice chamber changes the dimensions of the slice chamber. In this application, no by-pass is used. That is why at points (20, 21 and 3) the flow speeds change as a result of the adjustment.

SUMMARY OF THE INVENTION

The headbox according to the present invention is applicable to the following uses:

Single-layer headbox (horizontal, inclined, vertical):
- equipped with a tubular type turbulence generator
- equipped with a partition plate type turbulence generator In both cases, the slice flow can be adjusted (decreased from its maximum value) by directing a part of the slice flow out after the turbulence generator by using a flow dividing device.

Multi-layer headbox (horizontal, inclined, vertical):
- as above
- both types of turbulence generator can be installed in the same headbox so that, for example, the middle layer uses high-consistency stock and a turbulence generator with a partition plate, and the outer layers use conventional consistencies and a tubular type of turbulence generator.

For the slice flow adjustment, it is possible to install as many as three different flow dividing devices into the same headbox: a fixed or adjustable wedge in the middle of the slice chamber and, in addition, on the bottom and the "roof" of the slice chamber a hatch-like by-pass channel.

Figure 1:
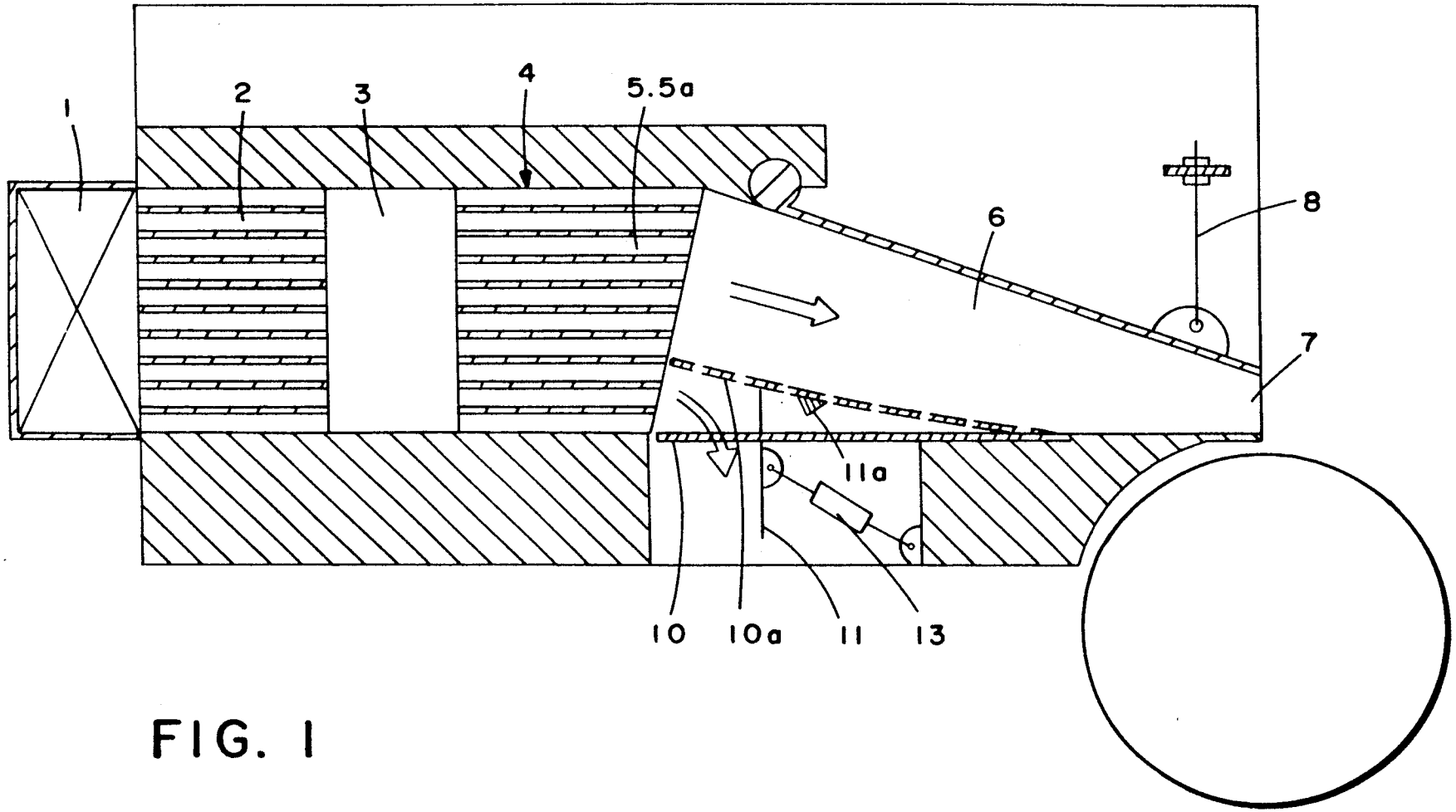
FIG. 1 illustrates the cross section of a headbox along the paper machine centre line. The bottom of the slice chamber is of flexible plate which is presented with a continuous line in the closed position and with a broken line in the opened position. The bottom plate in the closed position is marked with 10 and in the opened position with 10*a*. The actuator is an air/fluid cylinder. The headbox can be either horizontal or inclined/vertical.
Figure 2:
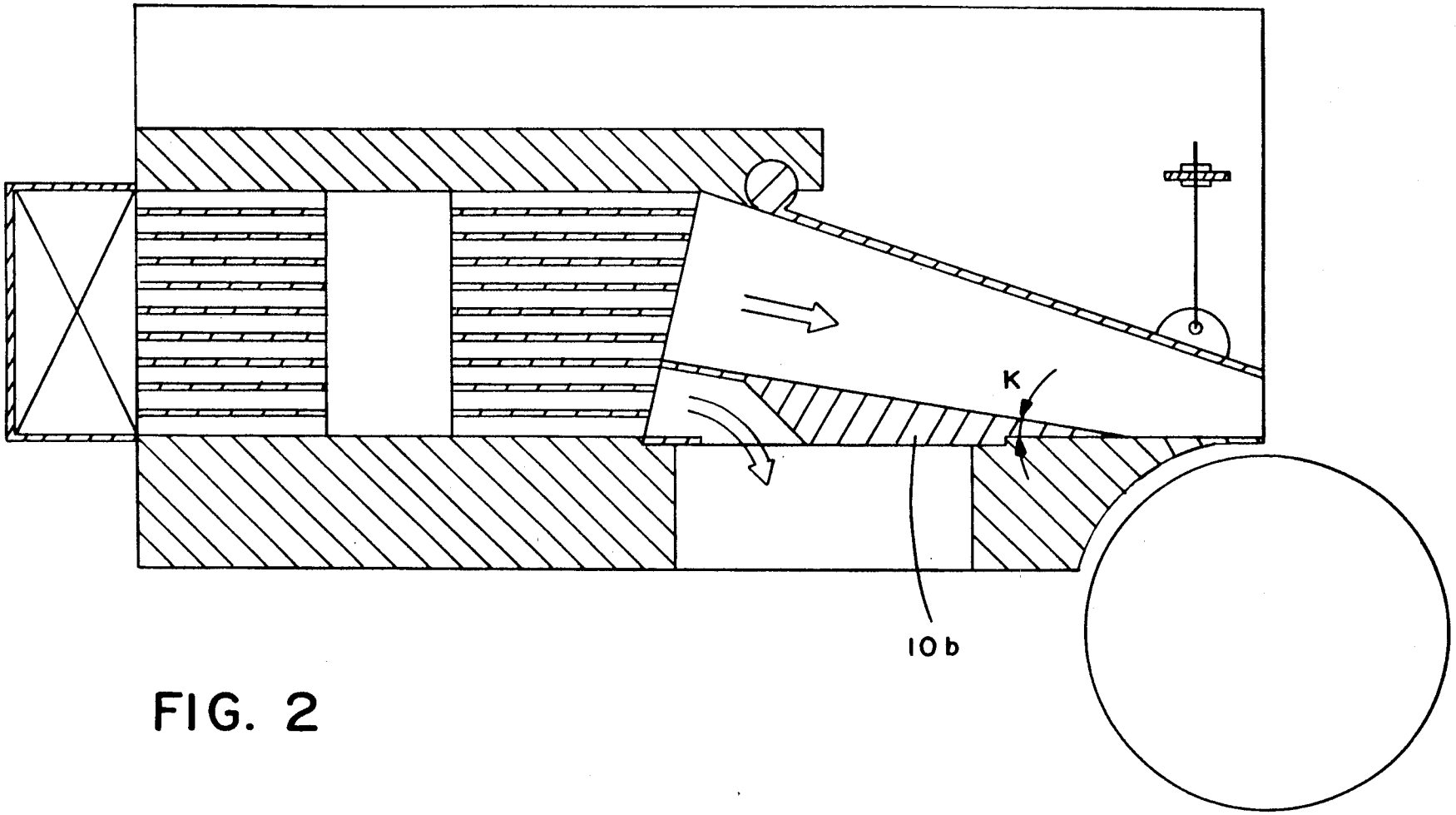

FIG. 2 illustrates a solution where the flexible bottom plate 10, 10*a* of FIG. 1 has been replaced by a detachable, interchangeable solid bottom plate 10*b*. The headbox can be either horizontal or inclined/vertical.

Figure 3:
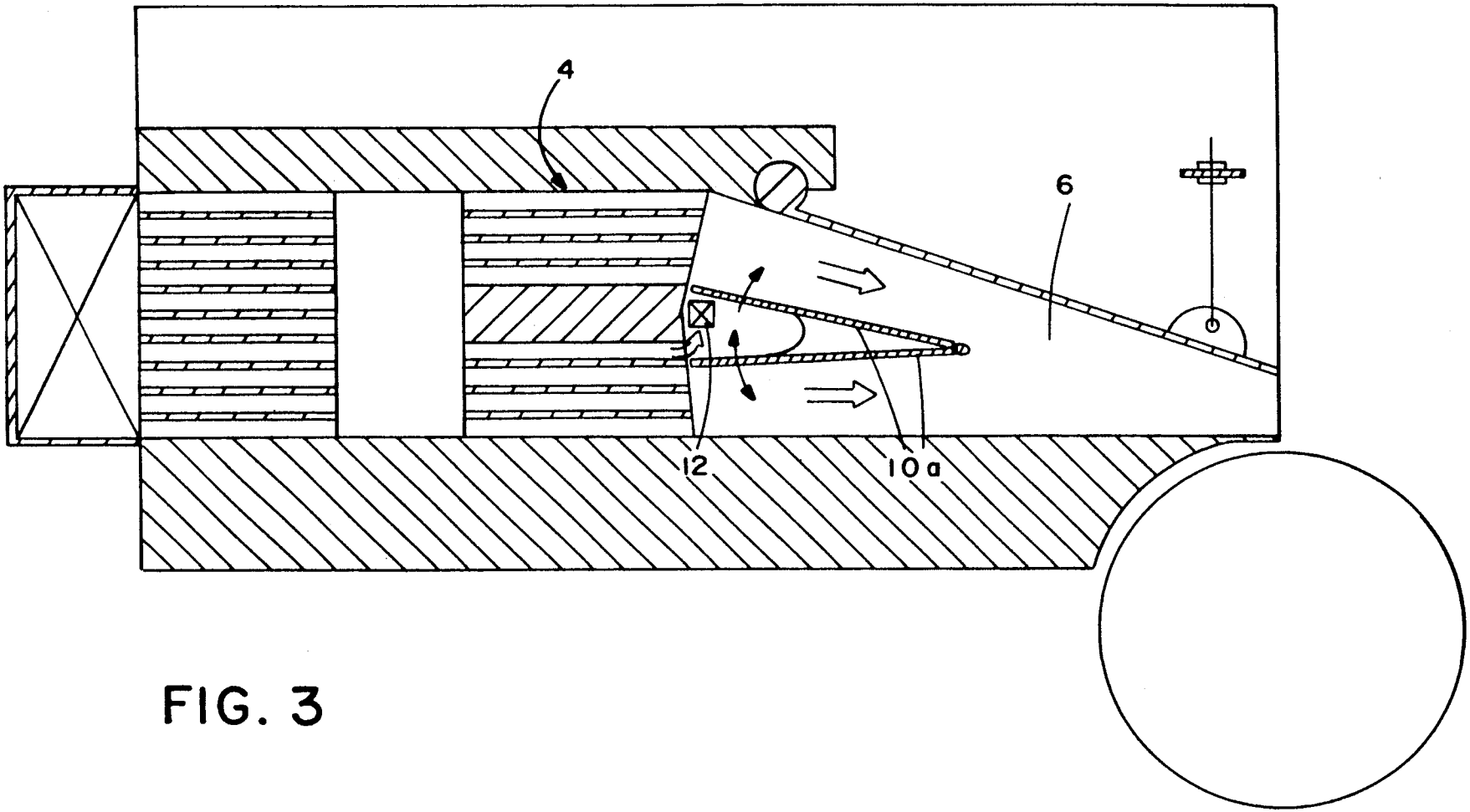

FIG. 3 illustrates a solution where the adjustment of the walls illustrated in the previous Figures has been replaced by a wedge-shaped flow divider (later referred to as a "wedge") limited by walls 10*c* located inside the slice chamber. One side of this wedge covers a part of the discharge surface of the turbulence generator. The wedge height can be fixed in which case the wedge can be changed to another for the purpose of adjustment, or, it can be adjustable by moving the walls 10*c* perpendicularly to the slice chamber centre line. Also this headbox can be either horizontal, inclined or vertical. The actuator is located inside the wedge, and it can be either mechanic, hydraulic or pneumatic. It is not shown in the Figure.

Figure 3A:
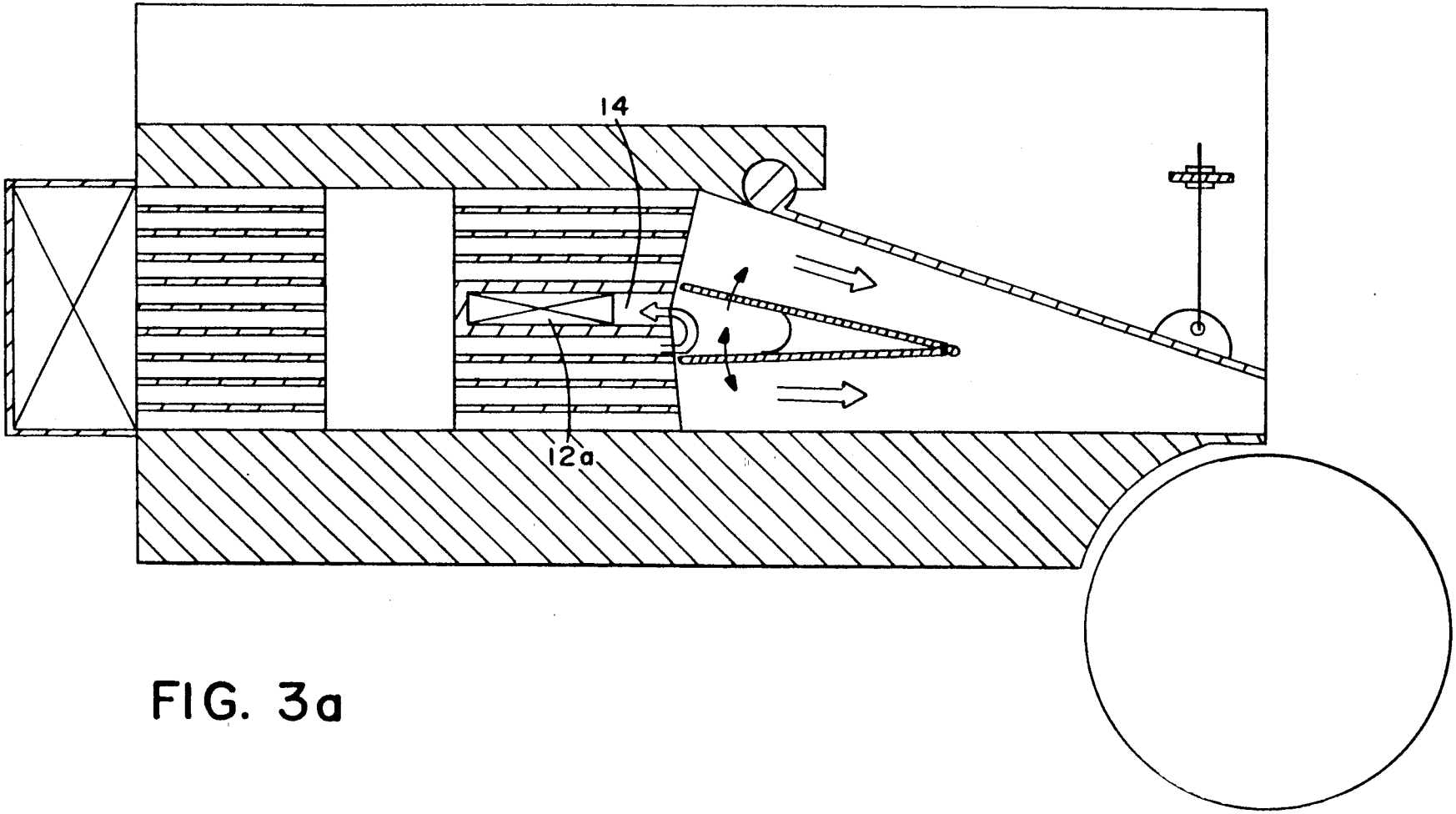

The solution in FIG. 3*a* differs from that in FIG. 3 in that as in the solution of FIG. 3 the stock gathered by the wedge is channelled through the wedge to both its ends and that way through the headbox side walls back to recycling. In FIG. 3*a*, the stock is taken into the channel located in the middle of the turbulence generator where discharge openings through the side walls of the headbox are provided.

Figure 3B:
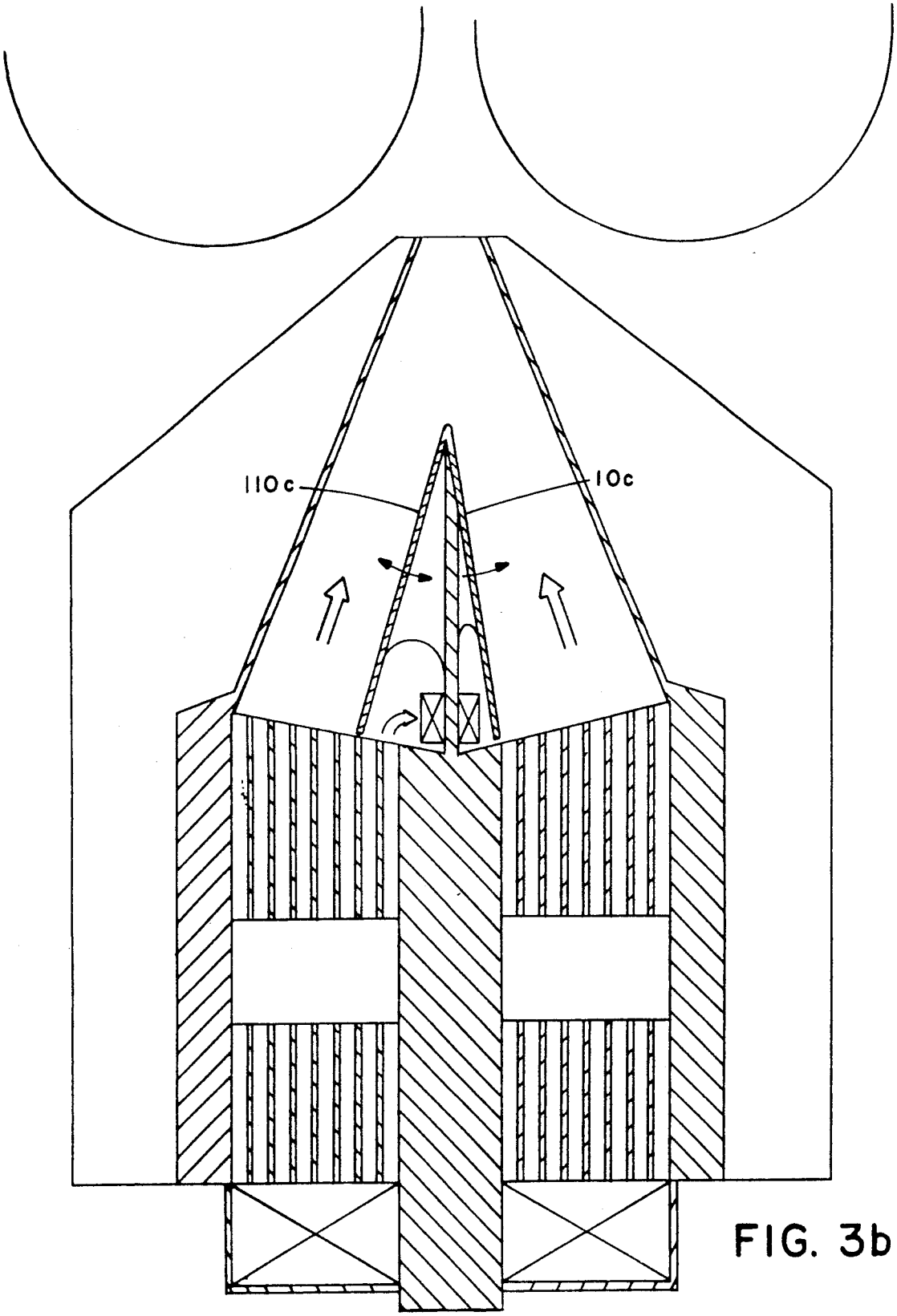

FIG. 3*b* illustrates the kind of solution represented in FIG. 3 with two separate flow channels to enable the use of two separate stocks. Both channels have a separate flow ratio adjustment device acting independently of one another. In this case the adjustment devices are wedges 10*c* and 110*c*, and the by-pass stocks flowed into them are kept separate from one another. According to FIG. 3*b*, the headbox can be vertical, but quite as well inclined/horizontal. Actuators are similar to those in the solution of FIG. 3.

Figure 3C:
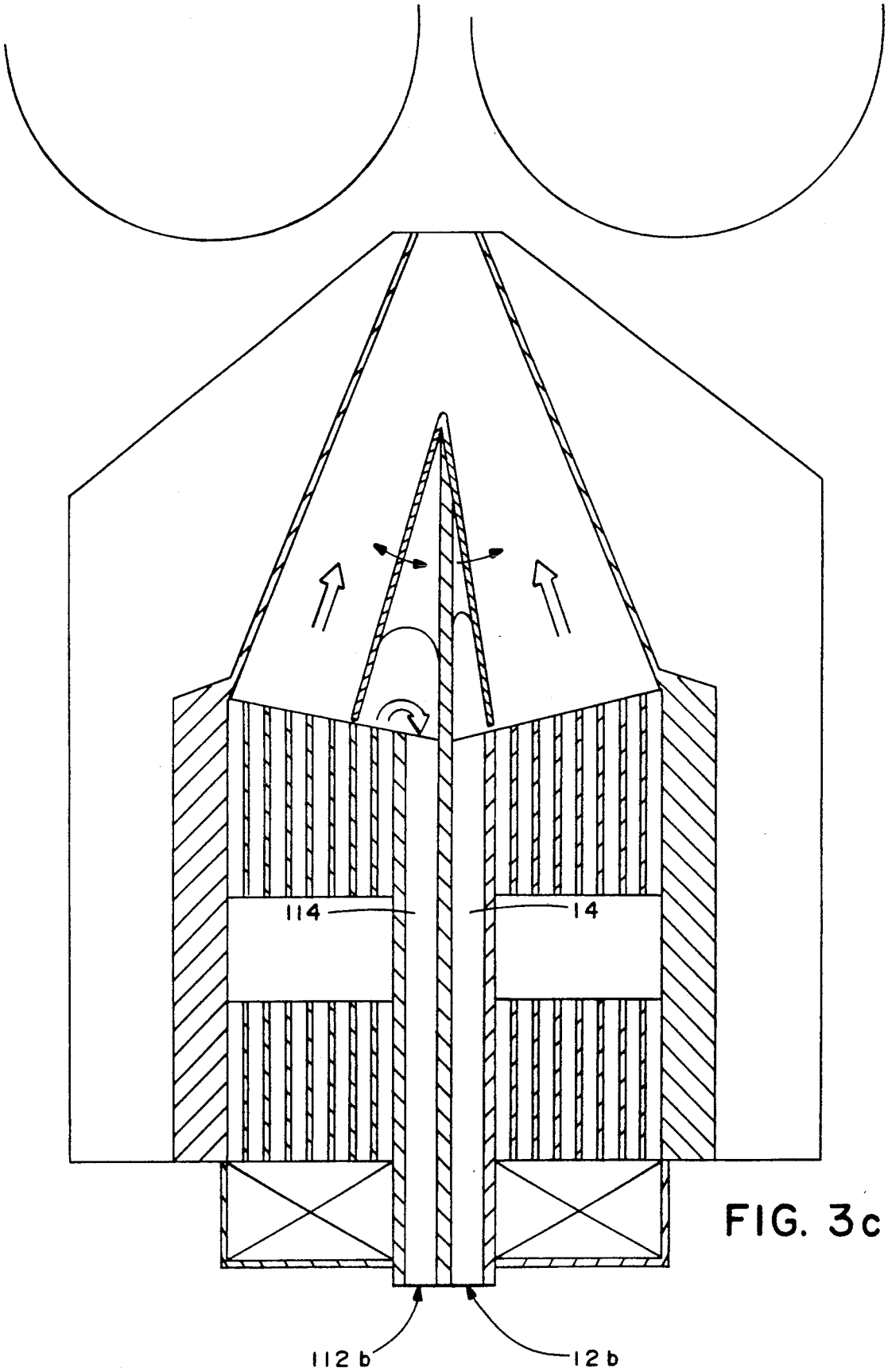

FIG. 3*c* illustrates the kind of stock discharge channel running through the turbulence generator presented in FIG. 3*a* applied to a multi-layer headbox. In this case each stock layer has a channel of its own which directs the stock gathered with the help of the wedge through the headbox rear wall back to recycling. Except for the discharge of the stock gathered with the help of the wedge, the solution is like that in FIG. 3*b*.

DETAILED DESCRIPTION OF THE DRAWINGS

The function of the apparatus according to the present invention is as follows (FIG. 1): From the feed pipe 1, the stock flows into the manifold 2 starting at the headbox back wall. When the stock flow has passed the manifold, the pulsations are dampened in the equalizing chamber 3 which is followed by a turbulence generator 4 which can either be formed of partition plates 5 with surface discontinuities to influence the flow, or of a tubular type turbulence generator 5*a*, the latter typically comprising stepped or tapered turbulence pipes. This section is followed by a slice chamber 6 whose dimensions in the vertical direction must be in right proportion to the flow rate produced by the turbulence generator. Finally, the stock flows out from the headbox onto the wire (not shown) through the slice opening 7. The height of the slice opening 7 is adjusted by means of the mechanism 8. All the above mentioned parts of the headbox are previously known. The flow control according to the invention is achieved by moving the bottom 10, 10*a* of the slice chamber 6 as described in the following:

The bottom 10, 10*a* of the slice chamber 6 is made of a rather thin, flexible sheet whose edge on the wire side is rigidly fixed. The edge on the side of the turbulence generator of the same plate 10 can, with the power units situated outside under the headbox, be displaced into the slice chamber 6 into position 10*a* so that one or more flow channels of the partition plate, or, correspondingly, some of the bottommost rows of pipes of the tubular turbulence generator are exposed below the plate 10, 10*a* so that the stock discharging from them is directed under the headbox and back to the recycling. Those channels or pipe rows that are above the front edge of the plate, 10, 10*a* discharge their flow to the slice chamber 6 and that way to the slice opening 7. The following is achieved with this arrangement:

The flow conditions of the feed pipe 1, manifold 2, equalizing chamber 3, turbulence generator 5, 5*a* are independent of the position of the plate 10, 10*a*.

Nor do the flow conditions or the pattern of turbulence of the slice chamber 6 change essentially except for the flow volume to the slice opening 7 that is decreased when the position of the bottom 10, 10*a* is changed towards the slice chamber.

The slice flow characteristics remain independent of the adjustment position of the plate 10, 10*a*, and thus the runnability of the machine is very good.

When using a method based on elastic deformation for the adjustment of the plate 10, 10*a*, a very simple structure is achieved. No hinge with a slit in the wall is necessary.

Figure 1A:
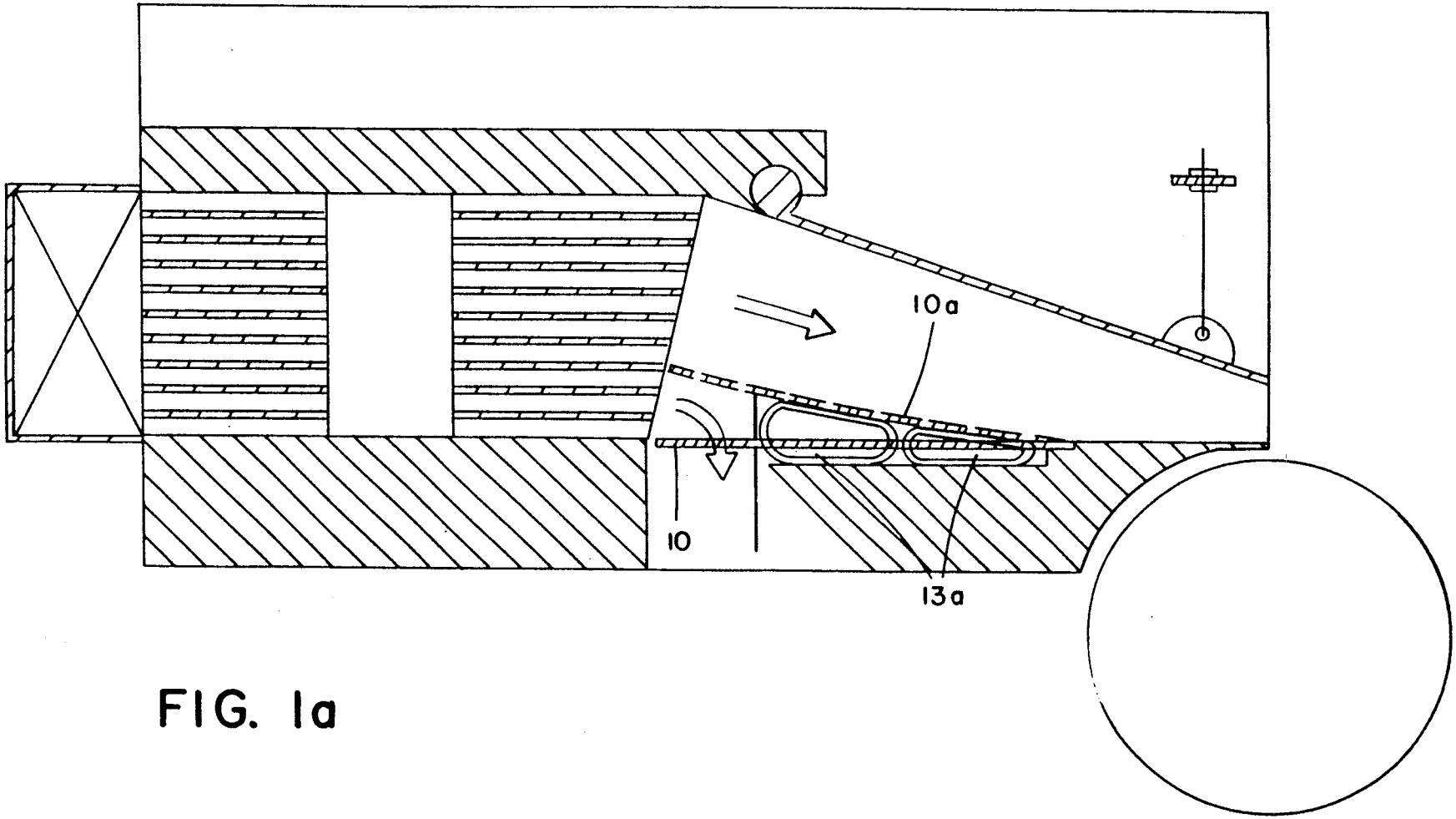
FIG. 1*a* illustrates a similar solution to that of FIG. 1 except that instead of an air/fluid cylinder the actuators are elastic expandable containers that are filled with gas or fluid to such a pressure that part 10, 10*a* bends.

The realization of this kind of structure also requires sufficient stiffness of the plate 10, 10*a*, the lifting/lowering method of the plate edge against the turbulence generator, and the channelling of the stock flow discharging from the bottom part of the turbulence generator back to recycling. These are details which can be achieved in several ways:

The stiffness of the plate 10, 10*a* can be improved with stiffeners 11, 11*a* attached to the bottom surface of the plate. These stiffeners are either parallelor perpendicular to the stock flow. The lifting/lowering can be carried out: 1) with hydraulic cylinders 13; 2) with a rack-and-pinion gear connected to the power unit, for example a step motor; 3) with a screw; or 4) with a horizontal shaft extending across the machine and from which connecting rods or cams lift/lower the plate 10, 10*a* when turning the shaft; or 5) with a pressure operated elastic container (13*a* in FIG. 1*a*). It is possible to direct the stock flow and also stiffen the plate using a vertical splash guard 11 attached to the plate 10, 10*a*. The splash guard 11 directs the discharging stock flow below the headbox without excessive splashing. The plate 11 makes the bottom plate 10, 10*a* notably stiffer at the same time.

Figure 1B:
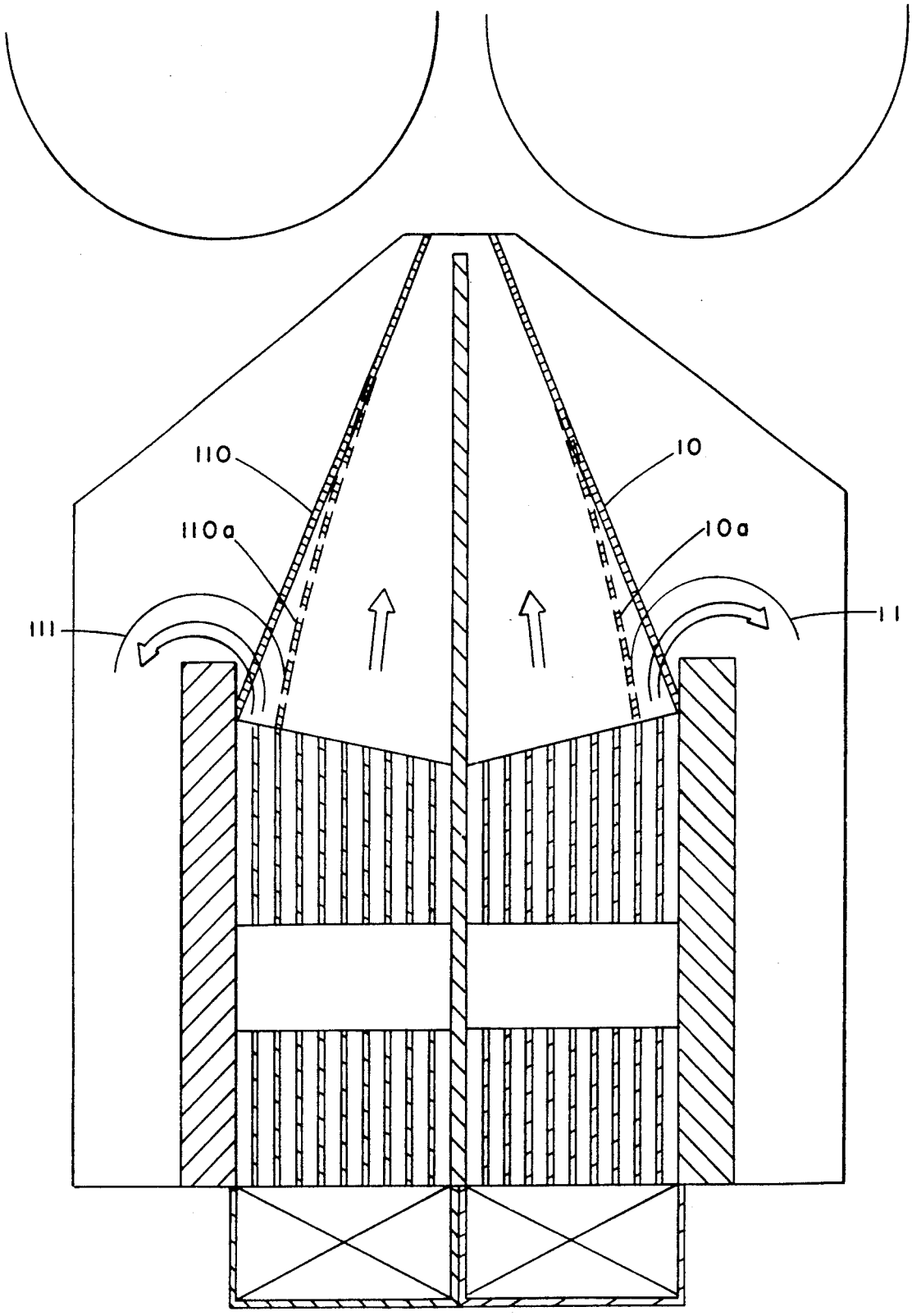
FIG. 1*b* illustrates a two-layer headbox which can be either vertical, as in the figure, or inclined or horizontal. The adjustment solution shown in FIG. 1 has been realized by opening the both walls 10, 10*a* and 110, 110*a* of the slice chamber thus exposing a part of the discharge surfaces of the turbulence generators outside the slice chamber. The actuators can either be according to FIG. 1 or 1*a*. They are not shown.

In the multi-layer solution illustrated in FIG. 1*b*, the separating of the flow takes place in the same way as in the single-layer headbox in FIG. 1. The headbox in FIG. 1*b* has two different channels for the stock flow. The parts of the right hand side channel are marked with the same numbers as those of the single-layer headbox (FIG. 1). The parts of the left hand side channel are marked with numbers that have been derived from the corresponding numbers of the right hand side channel by adding a hundred to them. Thus, for instance, the right hand side splash guard is marked with 11 and the left with 111.

The other parts of the headbox remaining as described above, the following alternatives can be used to replace the adjustment carried out with the flexible bottom plate 10, 10*a*:

An inclined bottom 10*b* (FIG. 2) is positioned in the place of the slice chamber bottom plate (10, 10*a* in FIG. 1). Now the inclined bottom 10*b* lets the flow coming from the lowest channels of the turbulence generator straight down. The adjustment is carried out by pulling the bottom 10*b* out through the headbox side wall, downwards through the discharge opening or through the slice opening of the headbox and replacing it with a bottom 10*b* with a different angle of inclination (K). When K=0°, the part 10*b* corresponds to the bottom plate in FIG. 1 in position 10.

This alternative is rather easy for workshop production. The flow control, however, is stepless only but, at each step, it is possible to reach flow conditions very near the optimum.

In the flow direction, after the turbulence generator 4 (FIG. 3) inside the slice chamber 6 and in the middle of it, a wedge 10*c* reaching across the machine is provided. The wedge is hollow so that it is capable of eliminating the output of the middlemost pipe rows or the plate holes and directing it out via the wedge ends 12 through the headbox side walls. The wedge 10*c* can be replaced with another wedge of a different height or it can be removed altogether through the headbox sidewall or the slice opening. The wedge 10*c* can also be made adjustable so that the height of the side that is against the turbulence generator can be steplessly adjusted from outside of the headbox.

In FIG. 3*a*, the stock gathered by the wedge is discharged backwards into the channel 14 in the turbulence generator and out from the headbox through the openings 12*a* in the headbox side walls.

In FIG. 3*b*, the adjustment according to FIG. 3 is applied to a multi-layer headbox. The numbering is as described in connection with FIG. 1*b*.

In FIG. 3*c*, the parts of the two different stock channels are numbered in the same way as in FIGS. 1*b* and 3*b*. In this solution, the stock gathered by the wedge is discharged backwards into channels 14 and 114 extending in the machine direction through the headbox and further out of the headbox through openings 12*b* and 112*b*.

Whether the flow is divided with a moving outer wall of the slice chamber or a wedge inside the slice chamber, the connecting point of such a dividing device and the discharge surface of the turbulence generator do not necessarily have to be totally liquid tight. Nor do the parts 10, 10*a*; 10*b*; 10*c*; 110, 110*a*; and 110*c* of the dividing device need to be linear in the direction of the breadth of the headbox. They can, for example, be either concave or convex so that the primary flow is divided to the slice opening and back to the recycling on the sides of the headbox in a different relation than in the middle of the headbox. This feature can be used to influence the grammage and orientation profiles of the web in the cross direction.

We claim:

1. In a headbox of a paper, board or pulp drying machine including, in sequence in a direction of stock flow, a header, a manifold, a turbulence generator and a slice chamber terminating at a slice opening, the improvement comprising flow dividing means downstream of said turbulence generator for altering a dimension of the slice chamber and structured and arranged to divert a portion of stock flow out of said slice chamber upstream of said slice opening without altering speed or direction of flow of non-diverted stock in said turbulence generator and said slice chamber, and means for adjusting said flow dividing means.

2. The headbox of claim 1 wherein said flow dividing means comprises at least one flexible wall defining a portion of said slice chamber, said wall having a free end adjacent said turbulence generator and a fixed end adjacent said slice opening, said means for adjusting said flow dividing means being effective to move said free end in a direction substantially perpendicular to the flow of stock.

3. The headbox of claim 1 wherein said flow dividing means comprises a plurality of interchangeable wall portions dimensioned to vary the size of the slice chamber and to thereby bypass different portions of stock flow from said turbulence generator to a conduit located external of the headbox and slice chamber.

4. The headbox of claim 1 wherein said flow dividing means comprises an adjustable wedge-shaped divider located within said slice chamber, a wider end of said divider facing said turbulence generator to thereby collect stock in an interior portion of said divider.

5. The headbox of claim 4 wherein said wedge-shaped divider is comprised of a pair of walls joined at first ends thereof, said means for adjusting said flow dividing means located in said interior portion.

6. The headbox of claim 4 wherein said wedge-shaped divider is arranged to divert stock flowing therein back to discharge channels located in the turbulence generator and out of the headbox.

7. The headbox of claim 4 wherein said turbulence generator has at least one partition wall extending into said wedge-shaped divider.

8. The headbox of claim 1 wherein the headbox is a multilayer headbox having at least two separate headers and at least two separate turbulence generators.

9. The headbox of claim 1 wherein said slice chamber is divided into a pair of flow channels, and wherein each flow channel is provided with means for adjusting flow of stock therethrough.

10. The headbox of claim 9 wherein the means for adjusting flow of stock through each of said pair of flow channels comprises a movable wall in each flow channel.

11. A method of adjusting the relation between highest and lowest flow-through volume of stock in a headbox in a paper, board or pulp drying machine, the headbox including, in sequence in the direction of stock flow, a header, a manifold, a turbulence generator and a slice chamber terminating at a slice opening, the method comprising the steps of:

altering a dimension of the slice chamber and thereby diverting a portion of stock flow from the slice chamber downstream of said turbulence generator and upstream of said slice opening without altering speed or direction of non-diverted stock in the turbulence generator and in the slice chamber.

12. The method of claim 11 wherein said portion of stock flow exiting a center portion of said turbulence generator is removed from said headbox.

13. The method of claim 11 wherein said portion of stock flow exiting opposite end portions of said turbulence generator is removed from said headbox.

14. The method of claim 11 wherein said portion of stock flow is removed by narrowing a dimension of said slice chamber.

15. The method of claim 11 wherein said portion of stock flow exiting said turbulence generator is diverted to a discharge passage in said turbulence generator which carries said portion out of the headbox.

16. The method of claim 11 wherein said portion of stock flow is removed in different proportions along a width dimension of the headbox, said width dimension extending substantially perpendicularly to the direction of stock flow.

17. The method of claim 11 and including the steps of dividing the slice chamber into a pair of flow channels, and removing stock flow from each of said flow channels.

* * * * *